United States Patent [19]

Jacobson

[11] Patent Number: 4,573,266

[45] **Date of Patent: * Mar. 4, 1986**

[54] RAZOR BLADE ASSEMBLY

[75] Inventor: Chester F. Jacobson, Southboro, Mass.

[73] Assignee: The Gillette Company, Boston, Mass.

[ * ] Notice: The portion of the term of this patent subsequent to Feb. 12, 2002 has been disclaimed.

[21] Appl. No.: 660,953

[22] Filed: Oct. 15, 1984

Related U.S. Application Data

[63] Continuation-in-part of Ser. No. 419,202, Sep. 17, 1982, Pat. No. 4,492,024.

[51] Int. Cl.[4] ..... B26B 21/22; B26B 21/44

[52] U.S. Cl. ..... 30/41; 30/87

[58] Field of Search ..... 30/50, 87, 41, 47

[56] References Cited

U.S. PATENT DOCUMENTS

| | | | |
|---|---|---|---|
| 2,292,418 | 8/1942 | Wetherbee | 30/32 |
| 3,768,161 | 10/1973 | Miller | 30/41 |
| 3,938,247 | 2/1976 | Carbonell | 30/47 |
| 3,950,849 | 4/1976 | Perry | 30/47 |
| 4,094,063 | 6/1978 | Trotta | 30/47 |
| 4,170,821 | 10/1979 | Booth | 30/41 |
| 4,266,340 | 5/1981 | Bowman | 30/89 |
| 4,270,268 | 6/1981 | Jacobson | 30/47 |
| 4,291,463 | 9/1981 | Williams | 30/346.53 |
| 4,381,293 | 4/1983 | Michel | 424/14 |
| 4,492,024 | 1/1985 | Jacobson | 30/87 |

FOREIGN PATENT DOCUMENTS 2024082A 5/1982 United Kingdom .

*Primary Examiner*—Jimmy C. Peters
*Attorney, Agent, or Firm*—Scott R. Foster

[57] ABSTRACT

A razor blade assembly comprising a blade disposed between skin engaging elements adapted in operation to engage a surface being shaved ahead and behind, respectively, of the cutting edge, the blade being movable relative to the elements in response to forces encountered during a shaving operation, the blade assembly having pivot mountings thereon for pivotal attachment to a razor handle, whereby the blade assembly, as a whole, may be pivotally movable on the handle in response to forces encountered during the shaving operation, one of the skin engaging elements being provided with a water leachable shaving aid.

3 Claims, 11 Drawing Figures

RAZOR BLADE ASSEMBLY

CROSS-REFERENCE TO RELATED APPLICATION

This is a continuation-in-part of application Ser. No. 419,202, filed Sept. 17, 1982, now U.S. Pat. No. 4,492,024, issued 1/8/85 in the name of Chester F. Jacobson.

BACKGROUND OF THE INVENTION

1. Field of the Invention

The invention relates to wet shaving implements and is directed more particularly to a blade assembly which, as a whole, is movable on a handle assembly during a shaving operation, and having individual blade assembly components which are independently movable during the shaving operation.

2. Description of the Prior Art

It is known in the art to provide a razor blade assembly which may be connected to, and used in conjunction with, a razor handle to facilitate shaving operations. U.S. Pat. No. 3,724,070, issued Apr. 3, 1973, in the name of Francis W. Dorion, Jr. shows a blade assembly in which blade means are held between blade assembly surfaces adapted to engage the surface being shaved in front of and behind, respectively, cutting edge portions of the blade means. Such surfaces are generally referred to as "guard" and "cap".

It is further known that the shaving efficiency of such a safety razor assembly may be improved if the blade assembly is adapted to pivot on the razor handle during a shaving operation, permitting the blade assembly to more closely follow the contours of a surface being shaved. U.S. Pat. No. 3,935,639, issued Feb. 3, 1976, in the name of John C. Terry, et al, and U.S. Pat. No. 3,938,247, issued Feb. 17, 1976, in the name of Nelson C. Carbonell, et al, are illustrative of razor handles adapted to accept the blade assembly of the '070 patent in such a manner as to permit pivotal movement of the blade assembly during a shaving operation. U.S. Pat. No. 3,950,849, issued Apr. 20, 1976, in the name of Roger L. Perry, illustrates a modified blade assembly adapted for pivotal movement. U.S. Pat. No. 4,026,016, issued May 31, 1977, in the name of Warren I. Nissen, and U.S. Pat. No. 4,083,104, issued Apr. 11, 1978, in the name of Warren I. Nissen, illustrate, respectively, a blade assembly and razor handle comprising a shaving system in which the blade assembly pivots on the handle during shaving. The shaving system shown in '016 and '104 patents has become well-known world-wide.

Another means by which increased shaving efficiency may be obtained is that of retaining the blade assembly, as a whole, stationary but permitting movement of individual components thereof in response to forces encountered during shaving. In U.S. Pat. No. 4,168,571, issued Sept. 25, 1979, in the name of John F. Francis, there is shown a blade assembly in which the guard, cap and blade means are each movable independently of each other in dynamic fashion. U.S. Pat. No. 4,270,268, issued June 2, 1981, in the name of Chester F. Jacobson, shows a blade assembly in which the guard and blade means are independently movable.

SUMMARY OF THE INVENTION

An object of the present invention is to provide a safety razor blade assembly which provides the benefits of the '016 and '104-type system, as well as the benefits of the '571 and/or '268-type system.

A further object of the invention is to provide a razor blade assembly as above described with a self-lubricating facility.

With the above and other objects in view, as will hereinafter appear, a feature of the present invention is the provision of a safety razor blade assembly comprising blade means having cutting edge means disposed between skin engaging elements adapted in operation to engage a surface being shaved ahead of and behind, respectively, the cutting edge means, the blade means being movable relative to the elements in response to forces encountered during a shaving operation, the blade assembly having pivot mounting means thereon for pivotal attachment to a razor handle assembly, whereby the blade assembly, as a whole, is pivotally movable on said handle assembly in response to forces encountered during the shaving operation, one of the skin-engaging elements being provided with a water leachable shaving aid.

The above and other features of the invention, including various novel details of construction and combinations of parts will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

DESCRIPTION OF THE DRAWINGS

Reference is made to the accompanying drawings in which is shown an illustrative embodiment of the invention from which its novel features and advantages will be apparent.

In the drawings.

DESCRIPTION OF THE PREFERRED EMBODIMENT

Figure 1:
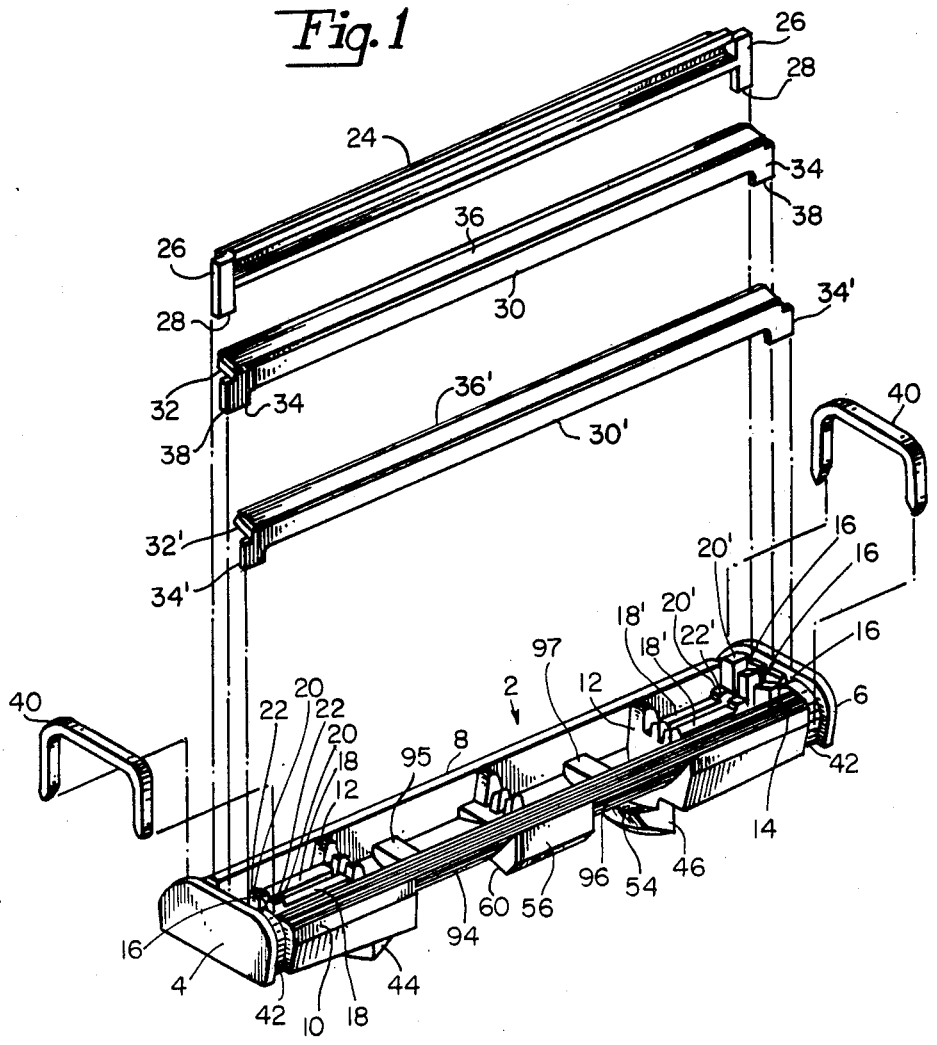
FIG. 1 is an exploded perspective view of one form of blade assembly illustrative of an embodiment of the invention.
Figure 2:
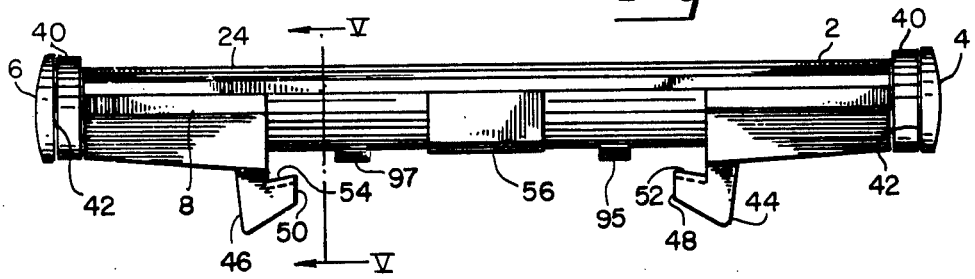
FIG. 2 is a front elevational view thereof.
Figure 3:
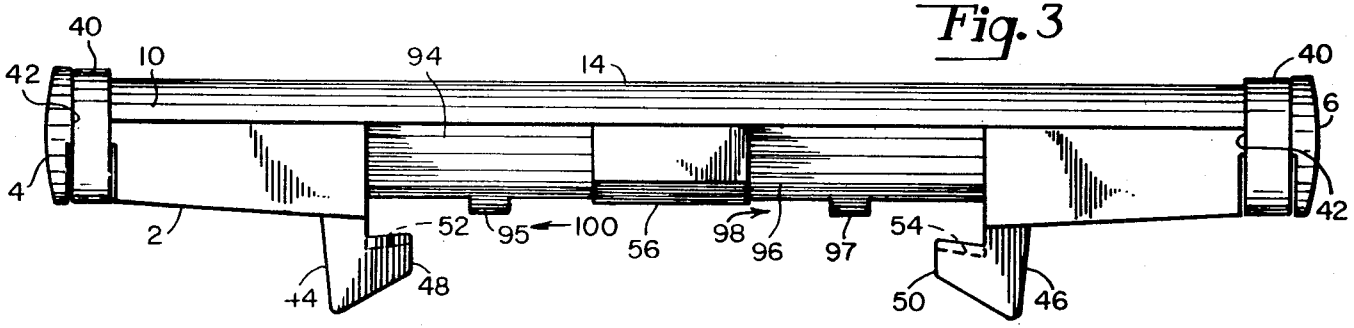
FIG. 3 is a back elevational view thereof.

Referring to the drawings, it will be seen that the illustrative razor blade assembly includes a body member 2 having first and second end portions 4, 6 interconnected by front and back wall portions 8, 10. Frame portions 12 extend width-wise of the body member, interconnecting the front and back walls 8, 10.

The back wall portion 10 of the body member 2 has an upper portion 14 which engages skin being shaved behind the cutting means of the assembly, thereby fulfilling the functions and occupying the position of the "cap" portion of conventional razor blade assemblies. Such portion 14 shall, for that reason, be referred to hereinafter as the "cap portion".

Each of the end portions 4, 6 is provided with opposed slots 16 disposed transversely to the frame portions 12. One of the frame portions 12 near the first end portion 4 is provided with spring fingers 18 extending therefrom generally parallel to the front and back walls 8, 10. Each of the fingers 18 is provided with an upturned end portion 20 having an upper surface 22. In like manner, another of the frame portions 12 near the second end portion 6 is provided with spring fingers 18' of similar configuration, with upturned end portions 20' having upper surfaces 22'. The fingers 18, 18' extend in opposite directions, the fingers 18 extending toward the first end portion 4 of the body member 2 and the fingers 18' extending toward the second end portion 6 of the body member. The fingers 18 and the fingers 18' are aligned with each other and with the slots 16.

The assembly includes a guard portion 24 having a slide member 26 at each end thereof. The slide members 26 are received in a pair of opposed slots 16 nearest the front wall portion 8. The bottom of the guard portion rests upon the surfaces 22, 22' of a pair of the spring fingers 18, 18'. The lower edges 28 of the slide members 26 rest above the bottoms of their slots 16, allowing the guard portion 24 to be moved further into the slots, against the bias of the spring fingers therebeneath. The spring fingers supporting the guard portion comprise a set of spring fingers, the object of which is to resiliently support the guard portion. In a shaving operation, the guard portion travels over the surface being shaved ahead of the cutting means.

The assembly further includes blade means comprising a blade support including a base portion 30, a platform portion 32 extending from the base portion, slide portions 34 at each end of the base portion, and a blade 36 fixed to the platform portion. The slide portions 34 are received in a pair of the opposed slots 16, with a bottom edge of the base portion 30 resting upon the surfaces 22 of a second pair of the spring fingers 18, 18'. Lower edges 38 of the slide portions 34 are spaced from the bottoms of their slots to permit movement of the blade support base portion further into the slots 16 against the bias of the spring fingers 18, 18' on which the blade support base portion rests. The spring fingers supporting the blade support comprise another set of spring fingers, the object of which is to resiliently support the blade means thereon.

In the embodiment illustrated, the blade means include a second blade support including a base portion 30', a platform portion 32', slide portions 34' and a blade 36', all anchored similarly to the above-described first blade support. The slide portions 34' are received in a third pair of the opposed slots 16 nearest the cap portion 14 with the base portion 30' resting upon spring finger surfaces. The spring fingers supporting the second blade support comprise still another set of spring fingers, which resiliently support the second blade. In a shaving operation, the second blade travels over the surface being shaved behind the first blade.

The guard portion 24, first and second blades 36, 36' are clamped in place by spring clamps 40, which are received in slots 42 in the end portions 4, 6. The clamps 40 engage the guard portion 24 and blades 36, 36', forcing them into the slots 16 to a point where a slight stress is placed on the spring fingers 18, 18'.

Figure 4:
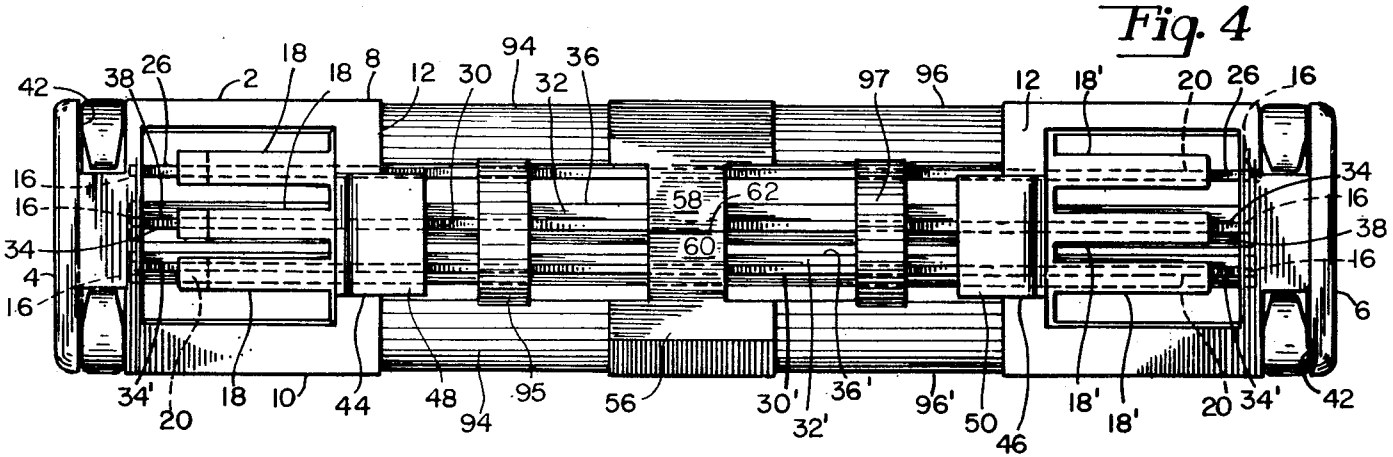
FIG. 4 is a bottom plan view thereof.
Figure 5:
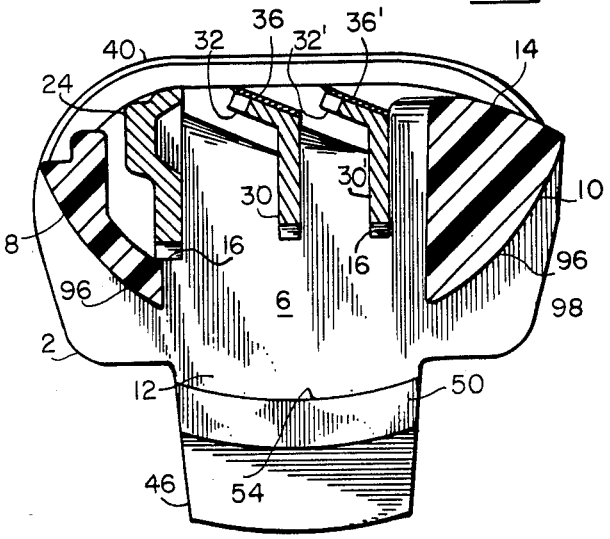
FIG. 5 is a sectional view, taken along line V—V of FIG. 2.

On the underside of the body member 2 and the frame portions 12, are disposed two extensions 44, 46 having at their free ends, respectively, inwardly extending opposed rails 48, 50, each rail having respective arcuate upper surfaces 52, 54. As will be further discussed below, the extensions comprise a pivot mounting means by which the blade assembly may be removably and pivotally attached to a razor handle. Referring to FIGS. 4 and 5, it will be seen that the blade assembly body member underside is additionally provided with cam means 56 comprising surfaces 58 and 60 joining at an apex 62, the surfaces 58, 60 defining therebetween an obtuse angle. As will be further described below, the cam means 56 is adapted to receive a cam follower operative to urge the blade assembly to a given position.

Figure 6:
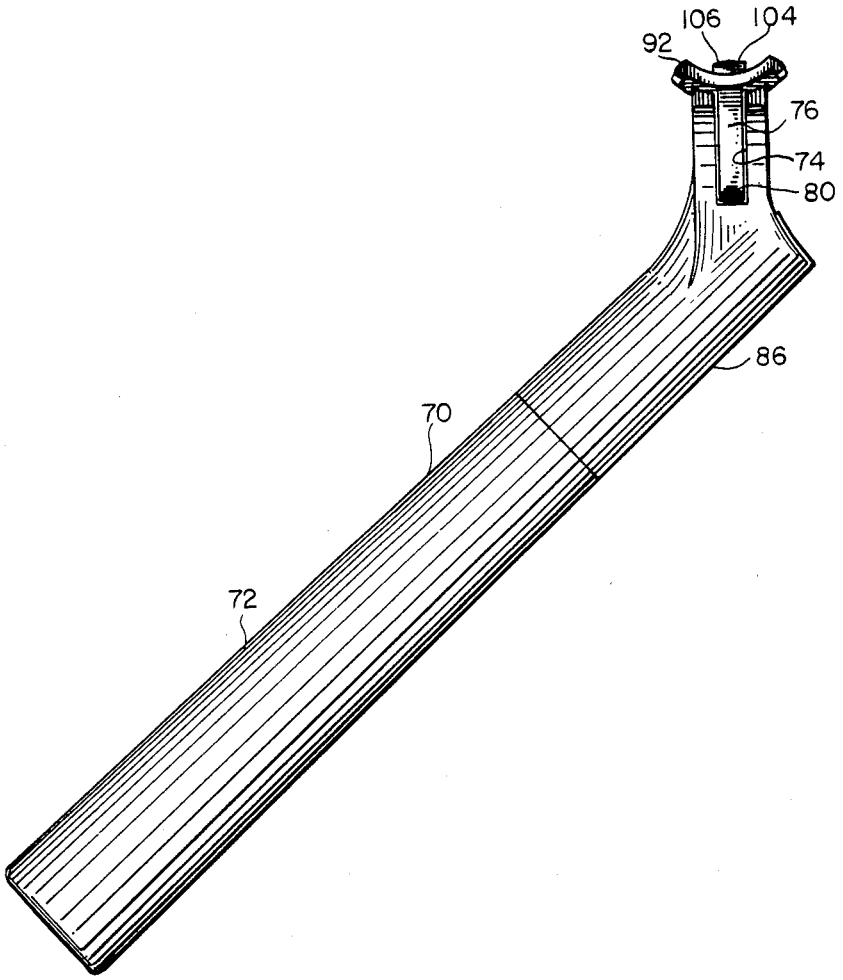
FIG. 6 is a side elevational view of one form of handle suitable for use with the invention.
Figure 7:
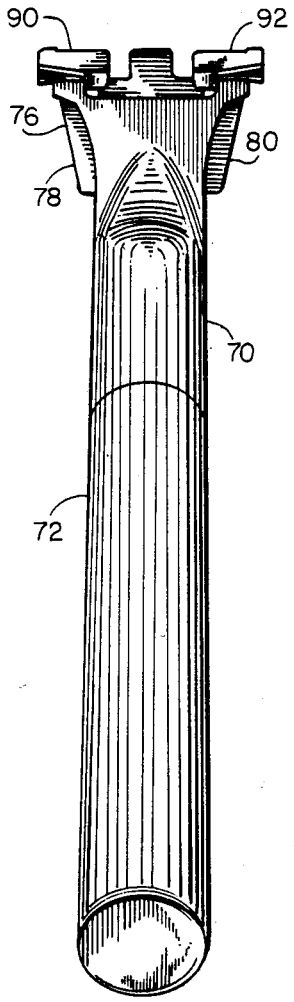
FIG. 7 is a front elevational view thereof.
Figure 8:
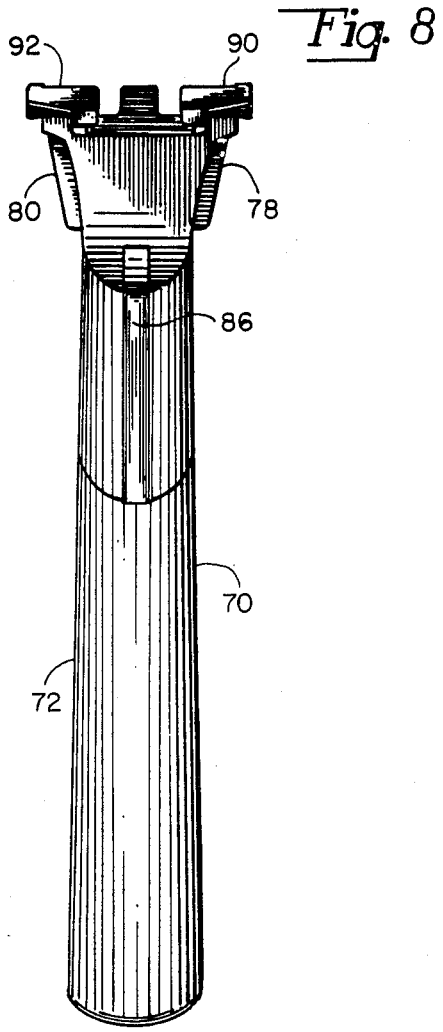
FIG. 8 is a back elevational view thereof.

Referring to FIGS. 6–8, it will be seen that a razor handle assembly 70, suitable for use with the illustrative blade assembly, includes a grip portion 72. One end of the grip portion 72 is provided with a recess 74 in which is disposed a molded plastic head portion 76 comprising two arms 78, 80 joined by a bridge portion 82. The grip portion 72 is further provided with a slot 84 in which is disposed a key member 86. The key member 86 includes a projection 88 which is disposed against the bridge portion 82 in a manner securely locking the head portion 76 to the grip portion 72. Each of the arms 78, 80 has disposed on its free end, respectively, a shell bearing 90, 92.

Referring again to FIG. 5, it will be seen that the blade assembly rails 48, 50, in conjunction with undersurfaces 94, 96 of the body member 2, and arcuate struts 95, 97, define arcuate slots 98, 100 adapted to receive the shell bearings 90, 92 respectively. Thus, the shell bearings 90, 92 comprise a shell bearing means which constitutes a pivot mounting means adapted to cooperate with the above described blade assembly pivot mounting means to facilitate pivotal connection of the blade assembly to the razor handle assembly (FIGS. 9 and 10).

In the handle recess 74, there is disposed a coil spring 102 and a plunger member 104, the spring biasing the plunger in the direction of the free end 106 of the plunger member 104. When the blade assembly is connected to the handle assembly, the free end 106 of the plunger member 104 is urged by the spring 102 into engagement with the blade assembly cam means 56. During pivoting operation of the blade assembly, the plunger end 106 bears against the cam surfaces 58, 60, to urge the blade assembly to a given position, the position in which the plunger end 106 rests at the apex 62 of the cam means 56.

Figure 9:
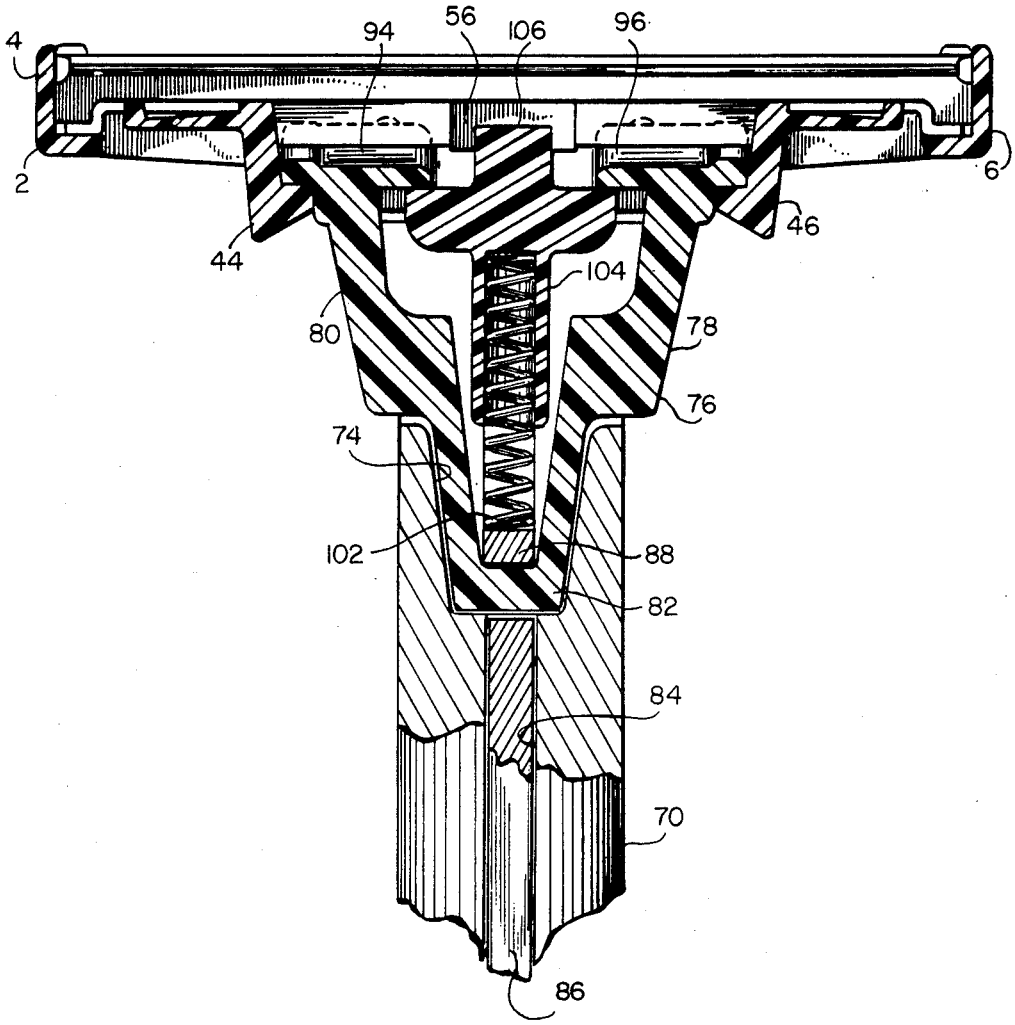
FIG. 9 is a sectional view of the blade assembly attached to the handle assembly, taken along the lengthwise centerline of the blade assembly.
Figure 10:
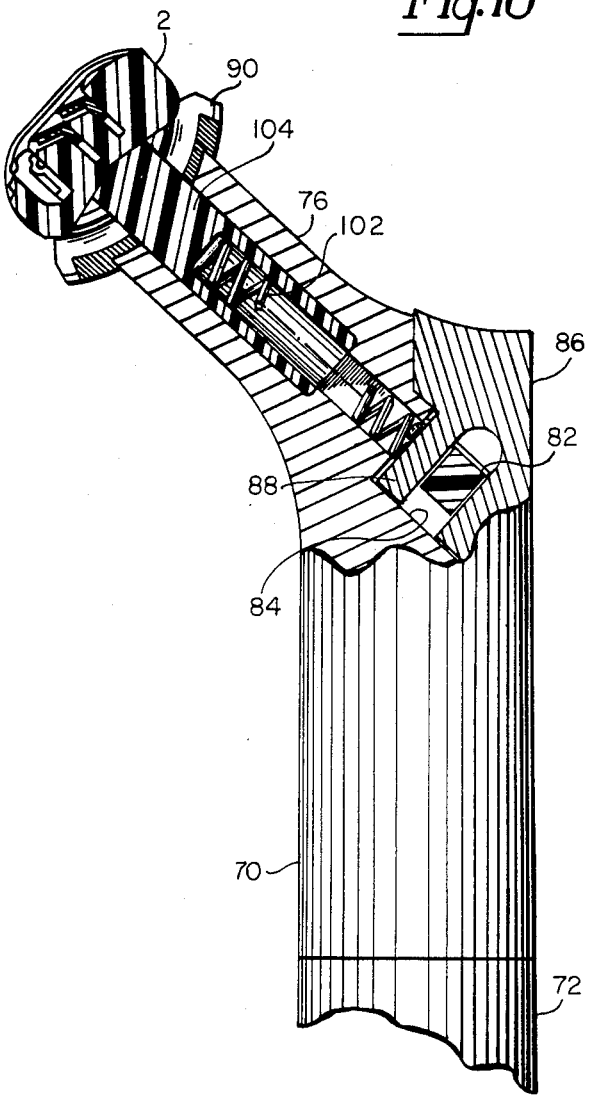
FIG. 10 is a sectional view of the blade assembly attached to the handle assembly, taken along the widthwise centerline of the blade assembly.

Referring particularly to FIGS. 8 and 9, it will be seen that the arms 78, 80 extend beyond the sides of the handle and are accessible to an operator. To connect the blade assembly to the handle assembly, the operator presses the arms 78, 80 inwardly, toward each other, moving the shell bearings 90, 92 toward each other.

The shell bearings 90, 92 are then pressed against the blade assembly underside arcuate struts 95, 97, and the arms 78, 80 released. Upon release of the arms 78, 80, the arms spring outwardly in opposite directions away from each other, the shell bearings 90, 92 entering the arcuate slots 98, 100. The spring biased plunger member 104 engages the cam means 56, seeking the apex 62 of the cam means and thereby urging the blade assembly to a "neutral" position.

During a shaving operation, the guard portion 24 and the blades 36, 36' move independently of each other against the bias of the spring fingers 18, 18'. Simultaneously, the blade assembly, as a whole, pivots on the handle, following the contours of the surface being shaved.

When it is desired to discard a used blade assembly, the operator need only compress the arms 78, 80, removing the shell bearings 90, 92 from the arcuate slots 98, 100 and releasing the blade assembly.

Figure 11:
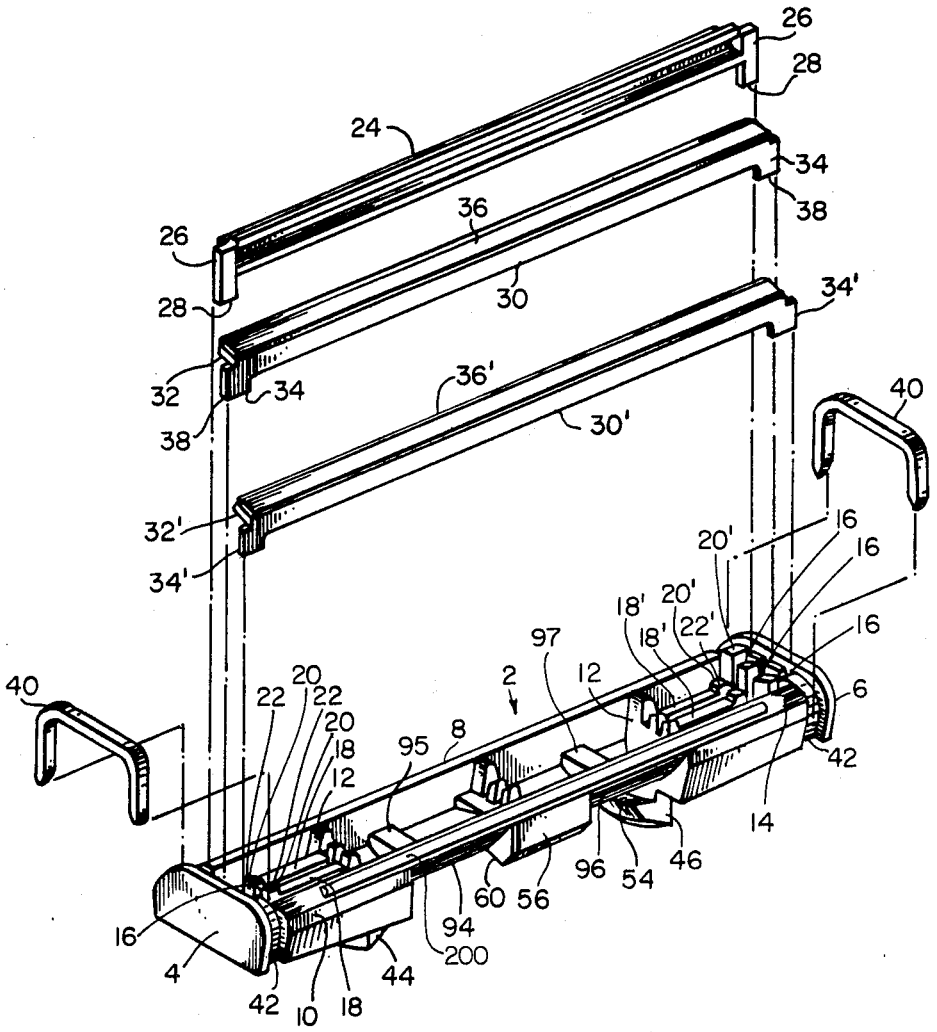
FIG. 11 is a perspective view of a portion of the blade assembly of FIG. 1, shown with an illustrative shaving aid body fixed thereto.

In FIG. 11, there is disclosed an embodiment in which one of the skin-engaging elements 14 is provided with a shaving aid 200 of the general type disclosed in U.S. Pat. Nos. 2,292,418, issued Aug. 11, 1942 to H. E. Wetherbee; and 4,170,821 issued Oct. 16, 1979 to Anthony R. Booth; as well as U. K. Pat. No. 2,024,082; application published Jan. 9, 1980; patent published May 6, 1982 in the name of Harry Pentney, et al.

The shaving aid 200 is preferably in the form of a body of material fixed to a skin-engaging surface, such as the cap portion 14 shown in FIG. 11 for illustrative purposes.

The shaving aid material preferably comprises a molded, extruded, or otherwise formed mixture of a hydrophobic material and a water leachable hydrophilic polymeric material such that, during a shaving operation, water present on the area to be shaved leaches out the hydrophilic material which may serve as a lubricant. Alternatively, one or more of the skin-engaging elements 14, 24 may be formed of the shaving aid mixture.

In operation, wetting the surface to be shaved with water prior to shaving causes, during shaving, leaching out of a portion of the water-soluble material which serves to lubricate the shaving surface. Thus, comfortable and effective shaving can be obtained by simply wetting the shaving area prior to shaving.

It is to be understood that the present invention is by no means limited to the particular construction herein disclosed and/or shown in the drawings, but also comprises any modifications or equivalents within the scope of the disclosure. For example, it is preferable under certain conditions that the guard portion be immovable. An alternative embodiment includes a guard portion fixed immovably to the blade assembly body member, but in all other respects structured and operated in accordance with the above description. As a further example, the blade means may include a single blade, rather than the two blade arrangement described, the single blade being used in conjunction with either a movable or stationary guard portion.

Having thus described my invention what I claim as new and desire to secure by Letters Patent of the United States is:

1. A razor blade assembly comprising a leading blade member having a first cutting edge and a following blade member having a second cutting edge, said cutting edges being parallel with each other and facing a same direction to act in tandem upon a surface being shaved, said leading and following blade members being disposed between guard and cap portions adapted in operation to engage said surface being shaved ahead of and behind, respectively, said first and second cutting edges, said leading and following blade members and said guard portion being movable independently of the remainder of said blade assembly and independently of each other in response to forces encountered during a shaving operation, a shaving aid fixed to one of said guard and cap portions, said shaving aid being formed of a hydrophobic material and a water leachable hydrophilic polymeric material, the blade assembly having pivot mounting means thereon for pivotal attachment to a razor handle assembly, the blade assembly, as a whole, being pivotally movable on said handle assembly in response to forces encountered during the shaving operation, and a cam means on said assembly adapted to receive a biasing means disposed in said handle assembly and adapted to exert a yieldable biasing force on said pivotally movable blade assembly, whereby to maintain maximum contact between said surface being shaved and said leading and following independently movable blades, said independently movable guard portion, and said shaving aid.

2. The razor blade assembly according to claim 1 in which said shaving aid member is fixed to said cap portion.

3. The razor blade assembly in accordance with claim 2 in which said cap portion is immovably fixed to said blade assembly.

* * * * *